US006127913A

United States Patent [19]

Niino et al.

[11] Patent Number: 6,127,913

[45] Date of Patent: Oct. 3, 2000

[54] THERMAL PROTECTOR

[75] Inventors: Masahiko Niino; Kazuo Ito; Tomoyuki Ito, all of Nagoya, Japan

[73] Assignee: Yamada Electric Mfg. Co., Ltd., Nagoya, Japan

[21] Appl. No.: 09/287,013

[22] Filed: Apr. 6, 1999

[30] Foreign Application Priority Data

Apr. 7, 1998 [JP] Japan ..... 10-112694
Dec. 3, 1998 [JP] Japan ..... 10-343727

[51] Int. Cl.[7] ..... H01H 37/54; H01H 37/52

[52] U.S. Cl. ..... 337/343; 337/377; 337/389; 337/390

[58] Field of Search ..... 337/333, 16, 36, 337/53, 77, 78, 89, 101, 102, 318, 324, 342, 343, 377, 389, 390, 391, 417; 29/622

[56] References Cited

U.S. PATENT DOCUMENTS

| | | | |
|---|---|---|---|
| 2,189,996 | 2/1940 | Riche | 337/40 |
| 3,670,283 | 6/1972 | Holden | 337/354 |
| 3,871,939 | 3/1975 | Woods | 156/293 |
| 3,946,352 | 3/1976 | Nelson | 337/361 |
| 4,032,180 | 6/1977 | Pohl | 292/341.16 |
| 4,088,976 | 5/1978 | Bell | 337/107 |
| 4,399,423 | 8/1983 | Nield | 337/102 |
| 4,414,519 | 11/1983 | Anderson, III et al. | 335/208 |
| 4,476,452 | 10/1984 | D'Entremont | 337/102 |
| 4,554,525 | 11/1985 | Bayer | 337/356 |
| 4,701,824 | 10/1987 | Beggs et al. | 361/24 |
| 4,706,152 | 11/1987 | DeFilippis et al. | 361/32 |
| 4,713,717 | 12/1987 | Pejouhy et al. | 361/26 |
| 4,720,759 | 1/1988 | Tabei | 361/105 |
| 4,862,133 | 8/1989 | Tabei | 337/102 |
| 5,182,538 | 1/1993 | Muller | 337/102 |
| 5,196,820 | 3/1993 | Ubukata | 337/368 |
| 5,309,131 | 5/1994 | Hofsass | 337/102 |
| 5,337,036 | 8/1994 | Kuczynski | 337/343 |
| 5,428,336 | 6/1995 | Smith et al. | 337/365 |

FOREIGN PATENT DOCUMENTS

| | | | |
|---|---|---|---|
| 4017864 | 11/1991 | Germany | H01H 37/64 |
| 4029527 | 3/1992 | Germany | H01H 37/54 |

OTHER PUBLICATIONS

Patent Abstracts of Japan, 04174925, dated Jun. 23, 1992, 1 page.
Patent Abstracts of Japan, 04174926, dated Jun. 23, 1992, 1 page.
Patent Abstracts of Japan, 05074295, dated Mar. 26, 1993, 1 page.
Patent Abstracts of Japan, 05074308, dated Mar. 26, 1993, 1 page.
Patent Abstracts of Japan, 05128948, dated May 25, 1993, 1 page.
Patent Abstracts of Japan, 05205586, dated Aug. 13, 1993, 1 page.
Patent Abstracts of Japan, 06084438, dated Mar. 25, 1994, 1 page.
Patent Abstracts of Japan, 06084439, dated Mar. 25, 1994, 1 page.
Patent Abstracts of Japan, 06119858, dated Apr. 28, 1994, 1 page.
Patent Abstracts of Japan, 08022757, dated Jan. 23, 1996, 1 page.

*Primary Examiner*—Leo P. Picard
*Assistant Examiner*—Anatoly Vortman
*Attorney, Agent, or Firm*—Pillsbury Madison & Sutro LLP

[57] ABSTRACT

A bimetal 40 is secured at a holding portion 40*b* to a fixed pin 52 and a snap portion 40*a* is supported by a support portion 12*a*. The free end 40*a*" of the snap portion 40*a* comes in contact with a movable contact plate 30 to thereby rock the plate 30. The displacement of the snap portion 40*a* is restricted at a boundary end portion 40*a*' by the holding portion 40*b*. Due to this, when the thermal protector carries out a snap action (or is reversed), the snap portion 40*a* is rocked like a lever around the support portion 12*a* supporting the snap portion 40*a*, and the free end 40*a*" of the snap portion 40*a* is greatly displaced. Thus, the travelling distance by which the movable contact 32 travels when the movable contact plate 30 is rocked, can be increased. This can prevent a delay in snap.

14 Claims, 10 Drawing Sheets

(A)

(C)

(D)

THERMAL PROTECTOR

BACKGROUND OF THE INVENTION

1. Field of the Invention

The present invention relates to a thermal protector suited for the protection of a motor which drives a hermetic compressor or the like of an air conditioner or an electric refrigerator.

2. Description of the Related Art

A thermal protector is mounted to a motor which drives a hermetic compressor or the like of an air conditioner or an electric refrigerator to protect the motor in an overload condition. The thermal protector of this type is disclosed by, for example, Japanese Unexamined Patent Application Publication No. 61-227631, which thermal protector will now be described with reference to FIG. 10A. A depressed portion 212*a* is formed at a base 212 of the thermal protector. A tray type bimetal 240 is housed in the depressed portion 212*a*. A heater 250 is provided below the tray type bimetal 240 and a movable contact plate 230 is provided above the bimetal 240. The movable contact plate 230 has one end secured to a fixed pin 252 and has a free end to which a movable contact 232 which comes in contact with a fixed contact 234 is mounted. The heater 250 is connected in series with a motor. The heater 250 generates heat by a current flowing through the motor and thereby heats the bimetal 240. FIG. 10A shows the bimetal 240 which carries out a downward snap action in a steady state. If the motor is overloaded and abnormal current flows through the motor, the bimetal 240 heated by the heater 250 carries out an upward snap action as shown in FIG. 10C. The bimetal 240 pushes the movable contact plate 230 up and separates the movable contact 232 from the fixed contact 234, thereby terminating current flow through the motor.

In the thermal protector with the above-stated structure, the bimetal 240 is only housed in the depressed portion 212*a* and not secured. This facilitates assembling the bimetal 240 into the thermal protector, but on the other hand, makes it difficult to keep a long stroke S (the traveling distance of the bimetal shown in FIG. 10C) of the action point of the bimetal 240 (the contact point of the bimetal 240 with the movable contact plate 230). As a result, a snap action tends to be delayed.

By "delay in snap actions" we mean as follows. The state of the bimetal bent to the greatest extent at ordinary temperature shown in FIG. 10(A) is changed to a state in which the bimetal is bent to a smaller extent when the bimetal is abnormally heated and then to a state in which the bimetal is bent to the smallest extent (in a concave state) shown in FIG. 10B. From this smallest bent state, the bimetal is reversed to a convex state. It is now necessary to separate the movable contact 232 from the fixed contact 234 while the snap action is being carried out. When the bending of the bimetal is at the smallest state, just before the snap action as shown in FIG. 10B, the movable contact 232 separates slightly from the fixed contact 234 just before the snap action is carried out, whereby an electric arc may be produced therebetween. The delay in snap action is also caused by bringing the movable contact 232 into contact with the fixed contact 234 just before the bimetal carries out a snap action or is reversed from a convex state to a concave state shown in FIG. 10(D). In order to prevent the delay of snap action during operation and recovery, the thermal protector structure as stated above only requires adjusting the position of the movable contact plate 230.

SUMMARY OF THE INVENTION

The present invention has been made to overcome the above-stated disadvantages. It is therefore, an object of the present invention to provide a thermal protector without causing a delay in snap action which can exhibit desired characteristics at low cost without the need to make any adjustments.

A thermal protector according to the present invention comprising a fixed contact; a movable contact plate supporting a movable contact coming in contact with the fixed contact; a bimetal rocking the movable contact plate and thereby separating the fixed contact from the movable contact; and a heater connected, in series, to the fixed contact and the movable contact and heating the bimetal, wherein the bimetal consists of a snap portion for carrying out a snap action and a holding portion holding the snap portion;

the bimetal is secured at the holding portion and supported by a support member abutting on the snap portion, the snap portion having a free end contacting with the movable contact plate and rocking the movable contact plate to thereby separate the fixed contact from the movable contact.

According to the invention, a bimetal consisting of a holding portion and a snap portion is secured at a holding portion and the snap portion is supported by a support member. The free end of the snap portion comes in contact with a movable contact plate to thereby rock the movable contact plate. In this case, the displacement of the snap portion is restricted at the holding portion and the snap portion is supported by the support member. Due to this, the travelling stroke by which the movable contact travels when the movable contact plate is rocked, can be increased. This can prevent a delay in snap action. Also, since the bimetal is secured at the holding portion and the snap portion thereof is supported by the support member, desired characteristics can only be obtained from assembling the components without making any adjustments. Thus, the thermal protector can be manufactured at low cost. Since the holding portion is, in particular, made smaller than the snap portion, the snap characteristics of the bimetal of the present invention is the same as that of a simple bimetal even with the holding portion secured. Thus, necessary characteristics can be easily attained.

In accordance with the more preferred teachings of the present invention, a heater is coiled around the columnar support member. Thus, the bimetal can be heated efficiently.

In accordance with the more preferred teachings of the present invention, the snap portion of the bimetal is generally formed rectangular. Due to this, the bimetal develops a strong force during a snap action, thereby making it possible to separate the fixed contact from the movable contact.

In accordance with the more preferred teachings of the present invention, an engagement portion is provided to engage the thermal protector with the actuating relay, the actuating relay can be mounted to the thermal protector. By making the actuating relay and the thermal protector integral with each other, the integral member can be mounted to a narrow space around the dome portion of a compressor incorporated in an air conditioner or an electric refrigerator only once without the need to conduct a mounting operation twice. Thus, the number of steps can be reduced.

A thermal protector according to the invention comprising a fixed contact; a movable contact plate supporting a movable contact coming in contact with the fixed contact; a main bimetal rocking the movable contact plate and thereby separating the fixed contact from the movable contact; and a heater connected, in series, to the fixed contact and the movable contact and heating the main bimetal, wherein the main bimetal consists of a snap portion for carrying out a snap action and a holding portion holding the snap portion, the main bimetal secured by the holding portion, the snap portion having a free end contacting with the movable contact plate to rock the movable contact plate and to thereby separate the fixed contact from the movable contact, and the thermal protector comprises a sub-bimetal having one end secured and the other end provided with a wedge type member, the sub-bimetal rocked perpendicular to a direction in which the fixed contact and the movable contact come in contact with and separate from each other, the sub-bimetal separating the fixed contact from the movable contact by the wedge type member if the fixed contact and the movable contact are welded.

According to the invention, the thermal protector is provided with a sub-bimetal rocked perpendicular to a direction in which the fixed contact and the movable contact come in contact with and separate from each other, and separating the fixed contact from the movable contact by the wedge type member if the fixed contact and the movable contact are welded. Therefore, even if the fixed contact is welded to the movable contact due to the deterioration of the main bimetal, current flow can be terminated to the motor which generates heat abnormally.

In accordance with the more preferred teachings of the present invention, the main bimetal consisting of the holding portion and the snap portion is supported by a support member. In this case, the displacement of the snap portion is restricted at the holding portion and the snap portion is supported by the support member. Due to this, the travelling stroke by which the movable contact travels when the movable contact plate is rocked, can be increased. This can prevent a delay in snap action.

A thermal protector according to the present invention comprising a fixed contact; a movable contact plate supporting a movable contact coming in contact with the fixed contact; a bimetal rocking the movable contact plate and thereby separating the fixed contact from the movable contact; and a heater connected, in series, to the fixed contact and the movable contact and heating the bimetal, wherein the bimetal consists of a snap portion for carrying out a snap action and a holding portion holding the snap portion.

the bimetal is secured at the holding portion, the snap portion having a free end contacting with the movable contact plate to rock the movable contact plate and to thereby separate the fixed contact from the movable contact.

A thermal protector according to the present invention comprising a fixed contact; a movable contact plate supporting a movable contact coming in contact with the fixed contact; a bimetal rocking the movable contact plate and thereby separating the fixed contact from the movable contact; and a heater connected, in series, to the fixed contact and the movable contact and heating the bimetal, wherein the bimetal consists of a snap portion for carrying out a snap action and a holding portion holding the snap portion, the bimetal secured by the holding portion, the snap portion having a free end contacting with the movable contact plate to rock the movable contact plate and to thereby separate the fixed contact from the movable contact, the thermal protector comprises a thin plate spring having both ends attached to each other by a low melting point metal at a high temperature if the fixed contact is welded to the movable contact, the both ends separated in a direction in which the fixed contact and the movable contact come in contact with and separate from each other to thereby separate the fixed contact from the movable contact.

In accordance with the more preferred teachings of the present invention, the thermal protector is provided with a thin plate spring separated in a direction in which the fixed contact and the movable contact come in contact with, and separate from each other to thereby separate the fixed contact from the movable contact if the fixed contact is welded to the movable contact. Therefore, even if the fixed contact is welded to the movable contact due to the deterioration of the bimetal, current flow can be terminated to the motor which generates heat abnormally.

In accordance with the more preferred teachings of the present invention, the bimetal consisting of the holding portion, the snap portion is secured at the holding portion and the snap portion is supported by a support member, and the free end of the snap portion comes in contact with the movable contact plate to thereby rock the movable contact plate. In this case, the displacement of the snap portion is restricted at the holding portion and the snap portion is supported by the support member. Due to this, the travelling stroke by which the movable contact travels can be increased when the movable contact plate is rocked. This can prevent a delay in snap action.

In accordance with the more preferred teachings of the present invention, the both ends of the thin plate spring of spring material such as copper alloy are fixed to each other through a solder with a distance of 0.1 mm or more kept therebetween. Due to this, even if compound layers of copper and tin contained in the solder are formed on the surfaces of the thin plate spring respectively, a sufficient solder thickness remains between the compound layers. This can prevent the both ends of the thin plate spring from fixedly adhering to each other and thereby preventing a malfunction occurrence. Since the distance between the both end portions is 1 mm or less, no malfunction occurs due to vibration.

DESCRIPTION OF THE PREFERRED EMBODIMENTS

According to the present invention a thermal protector in the first embodiment will now be described with reference to the accompanying drawings.

Figure 6:
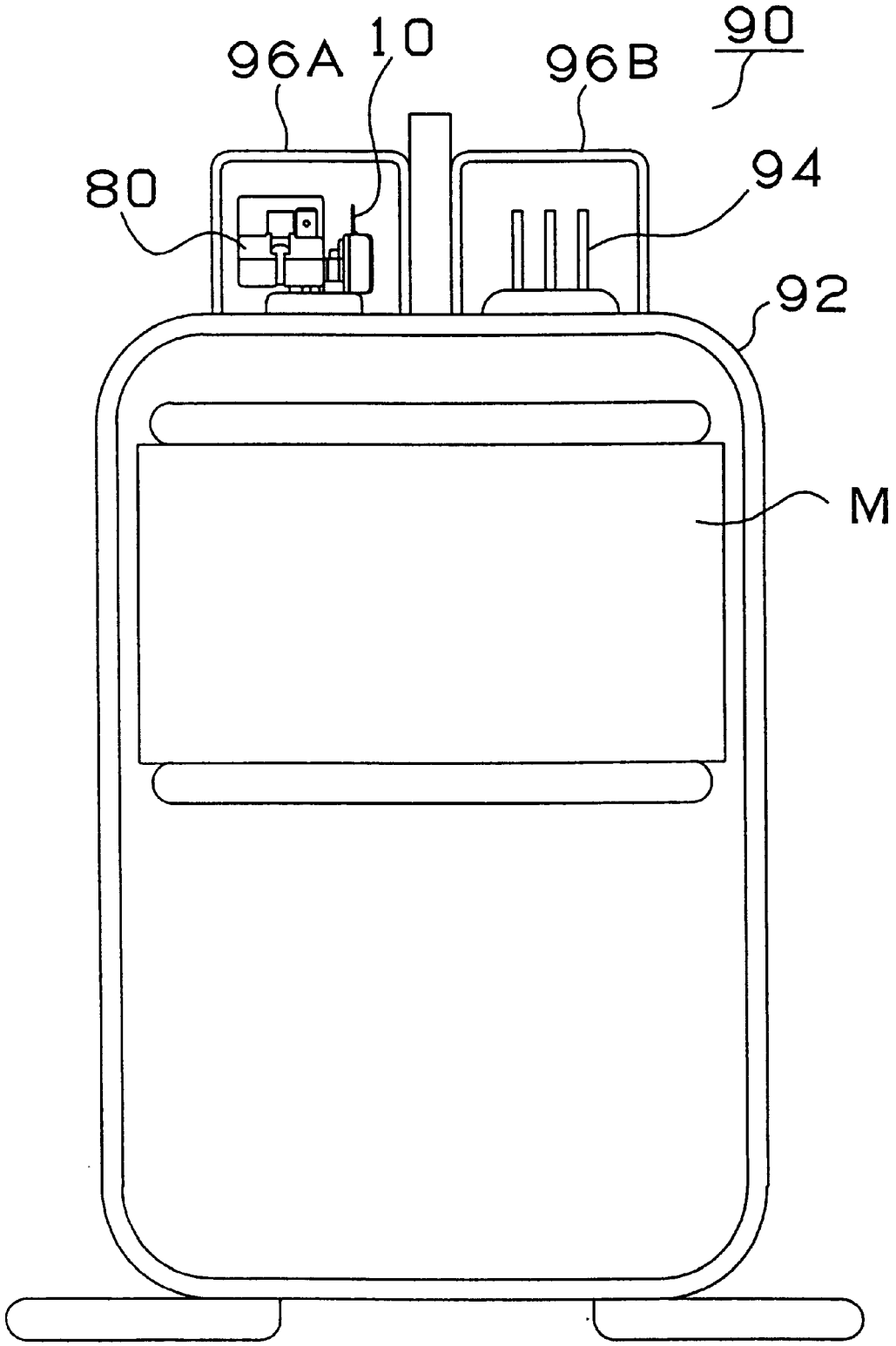
FIG. 6 is an explanatory view showing a state in which the thermal protector and the actuating relay are mounted to a compressor.

A thermal protector 10 in the first embodiment is mounted, integrally with an actuating relay 80 using a PTC or the like, on the outer surface of a dome 92, of for example a compressor 90 and is protected by a cover 96 as shown in FIG. 6. A motor M is housed in the compressor 90.

FIGS. 1A to 1F show the outlines of the thermal protector 10. FIGS. 2 and 3 show the interior structures of the thermal protector 10. FIG. 1C is specifically a plan view of the thermal protector 10, FIGS. 1A, 1B, 1D and 1E are side views thereof, and FIG. 1F is a bottom view thereof. As shown in FIG. 1E, the thermal protector 10 consists of a base 12 of polyester and a cover 14 of PBT resin. As shown in FIG. 1C, a pin terminal 24 is arranged on the upper surface of the thermal protector 10 to fit a pin (not shown) extending from a motor side therein. A tab terminal 22, which extends sidewise, is arranged on the side surface of the thermal protector 10 to insert a power supply side receptacle (not shown) therein.

FIG. 2G is a plan view of the thermal protector 10 of FIG. 1C in a state in which the cover 14 is taken off from the protector 10. FIGS. 2H and 2I are cross-sectional views of the thermal protector 10 taken along line H—H of FIG. 1C. FIGS. 3J, 3K and 3L are cross-sectional views of the thermal protector 10 taken along lines J—J, K—K and L—L of FIG. 1C, respectively. FIG. 3M is a plan view of a bimetal.

As shown in FIG. 2H, the thermal protector 10 has a bimetal 40 secured to a fixed pin 52 or welded to a connecting plate 44. A heater 50 is provided below the bimetal 40. A movable contact plate 30 is provided above the bimetal 40. The movable contact plate 30 has one end secured to the fixed pin 52, and a free end to which a movable contact 32 in contact with the fixed contact 34, is attached.

The electrical connection of the thermal protector 10 will be described with reference to FIG. 4. The tab terminal 22 of the thermal protector 10 is connected to a power supply side receptacle which is not shown and also connected to the heater 50. The heater 50 is connected to the movable contact plate 30. The contact 32 of the movable contact plate 30 is connected to the fixed contact 34, which contact 34 is connected to the pin terminal 24 in a steady state. The first pin terminal T1 of the motor M is fitted into the pin terminal 24.

The motor M includes a main coil MC and an actuating coil AC. The main coil MC is connected to the second terminal T2 and the actuating coil AC is connected to the third terminal T3. A main capacitor C1 for improving a power factor, an actuating relay 80 and an actuating capacitor C2 are also connected in parallel, to the third terminal T3. As stated above with reference to FIG. 6, the thermal protector 10 in this embodiment is mounted integrally with the actuating relay 80, on the compressor 90 provided with the motor M. The thermal protector 10 may be used with a motor which only includes the actuating capacitor C2 or a motor which does not employ a capacitor.

The actuating relay 80 using the PTC has a low resistance when the motor is actuated, i.e., when the temperature of the PTC is low. The relay 80 carries high current through the actuating coil AC to thereby actuate the motor M. After a few seconds when the motor M has been actuated, the resistance of the relay 80 is increased by the current flowing at the time the motor M is actuated to thereby block the current from carrying through the actuating coil AC. While the motor M is running in a steady state, current of about 20 to 30 mmA flows through the coils, thereby maintaining the actuating relay 80 at high temperature and high resistance.

Figure 4:
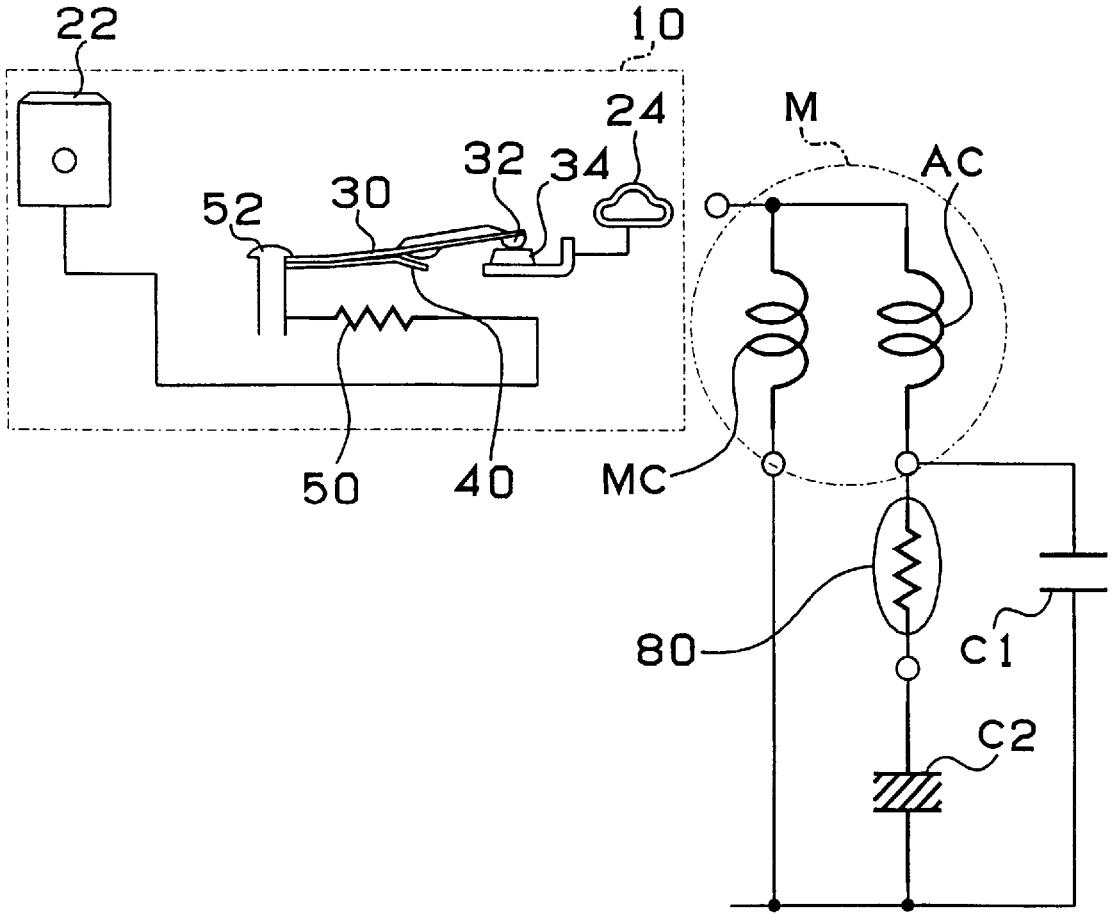
FIG. 4 is a circuit diagram showing how the thermal protector is connected to an actuating relay.

Meanwhile, the movable contact 32 comes in contact with the fixed contact 34 in the thermal protector 10 before the bimetal 40 is reversed (or perform a snap action) as shown in FIGS. 4 and 2H. The protector 10 supplies current inputted through the tab terminal 22 from a power supply toward the motor M.

If overcurrent is applied to the motor M due to the overload of the motor M or constraint to a rotor thereof, the calorific power of the heater 50 increases. When the temperature of the bimetal 40 reaches a preset level (e.g., 120° C.), the bimetal 40 is reversed from a convex state to a concave state as shown in FIG. 2I to push the movable contact plate 30 up, thereby separating the movable contact 32 from the fixed contact 34. As a result, power supply to the motor M is terminated and the motor M is protected. If power supply to the motor M is terminated, current flow to the heater 50 is stopped, thereby decreasing the temperature of the bimetal 40. If the temperature of the bimetal 40 reaches a preset level, the bimetal is reversed from a concave state to a convex state. Thus, as shown in FIG. 2H, the movable contact 32 is again brought into contact with the fixed contact 34 from the elasticity of the contact plate 30 and power supply to the motor M resumes.

Figure 1:
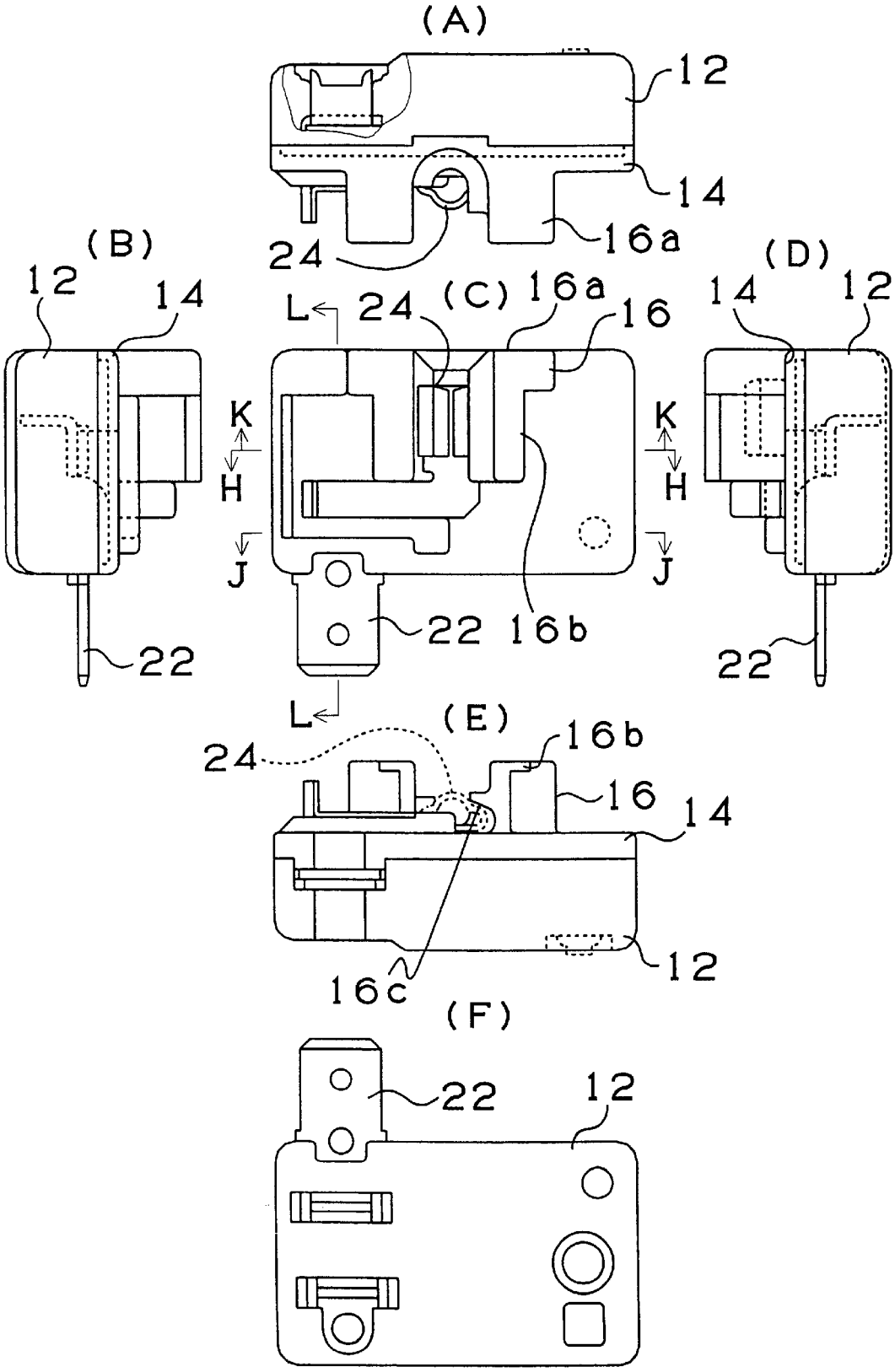
FIG. 1C is a plan view of a thermal protector in the first embodiment according to the present invention.
FIGS. 1A, 1B, 1D and 1E are side views thereof.
FIG. 1F is a bottom view thereof.
Figure 2:
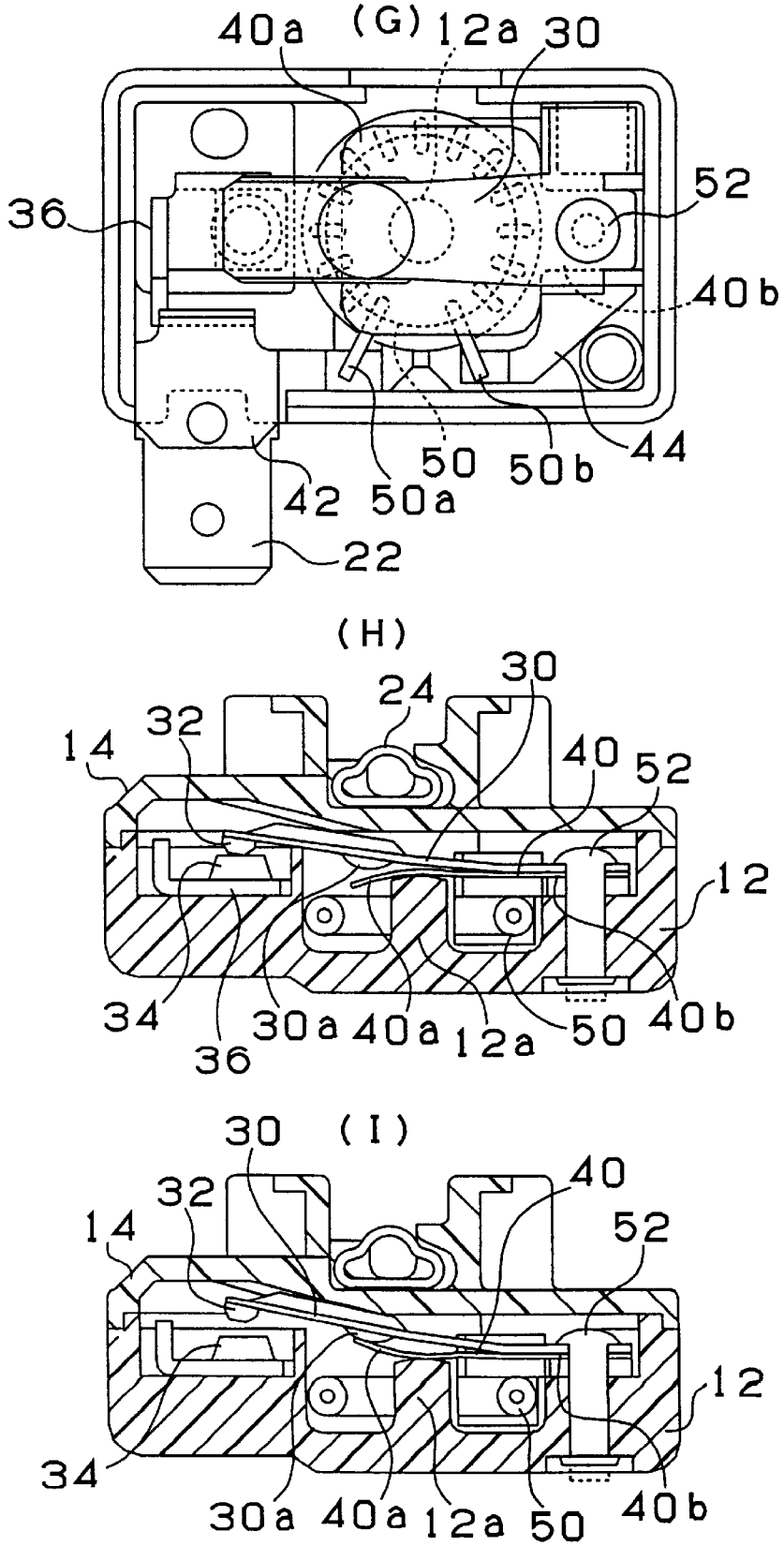
FIG. 2G is a plan view showing a state in which a cover is taken off from the thermal protector shown in FIG. 1C.
FIGS. 2H and 2I are cross-sectional views of the thermal protector, taken along line H—H of FIG. 1C.
Figure 3:
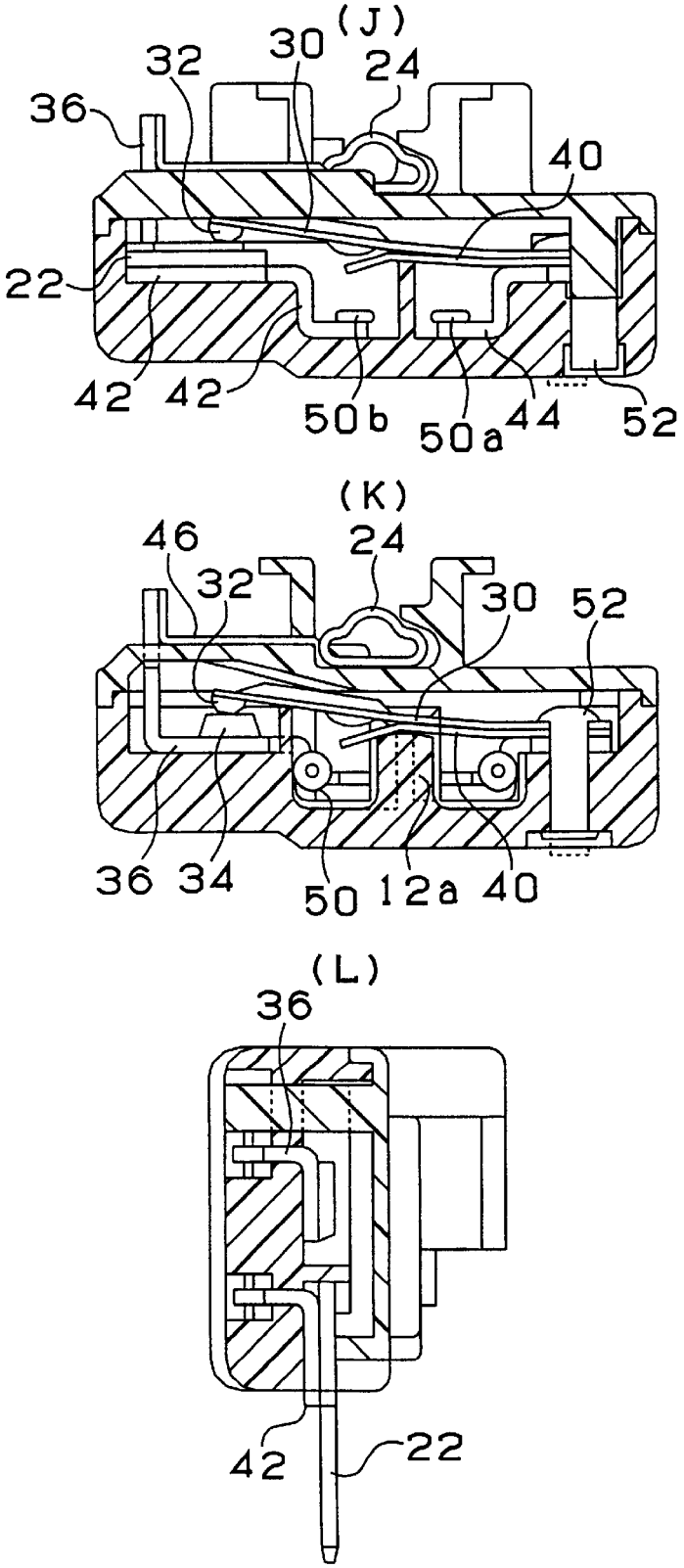
FIG. 3J is a cross-sectional view of the thermal protector, taken along line J—J of FIG. 1C.
FIG. 3K is a cross-sectional view thereof, taken along line K—K of FIG. 1C.
FIG. 3L is a cross-sectional view thereof, taken along line L—L.
FIG. 3M is a plan view of a bimetal.

The mechanical structure of the thermal protector 10 will be now described in more detail, with reference to FIGS. 1 to 3.

The tab terminal 22 connected to the power supply side receptacle is formed into a flat plate shape as shown in FIG. 2G. A cranked-formed connecting plate 42 (see FIG. 3J) is spot-welded to the tab terminal 22 and connected to the terminal 50*a* of the heater 50 through the connecting plate 42. The heater 50 is formed by coiling a Nichrome or an iron-chromium alloy wire and housed in a depressed portion 12C formed at the base 12. The other end 50*b* of the heater 50 is connected to a fixed pin 52 trough a cranked connecting plate 44 (see FIG. 3J). The fixed pin 52 crimps the connecting plate 44, the bimetal 40 and the movable contact plate 30. The bimetal 40 and the movable contact plate 30 can be welded to the connecting plate 44 without using a pin.

The bimetal 40 consists of a generally rectangular snap portion 40*a* and a holding portion 40*b* holding the snap portion as shown in FIG. 3M. The snap portion 40*a* is formed in the same manner as a tray type bimetal and has a curvature inverted (from a concave state to a convex state) at a predetermined temperature. As shown in FIG. 2I, the holding portion 40*b* of the bimetal 40 is secured to the fixed pin 52 or the portion 40*b* is together with the movable contact plate 30, welded to the connecting plate 44; whereas the snap portion 40*a* is supported by a columnar support 12*a* formed at the base 12. Since the coiled heater 50 is arranged within the depressed portion 12*c* around the support 12*a*, heat generated at the heater 50 is efficiently transferred to the bimetal 40.

Figure 10:
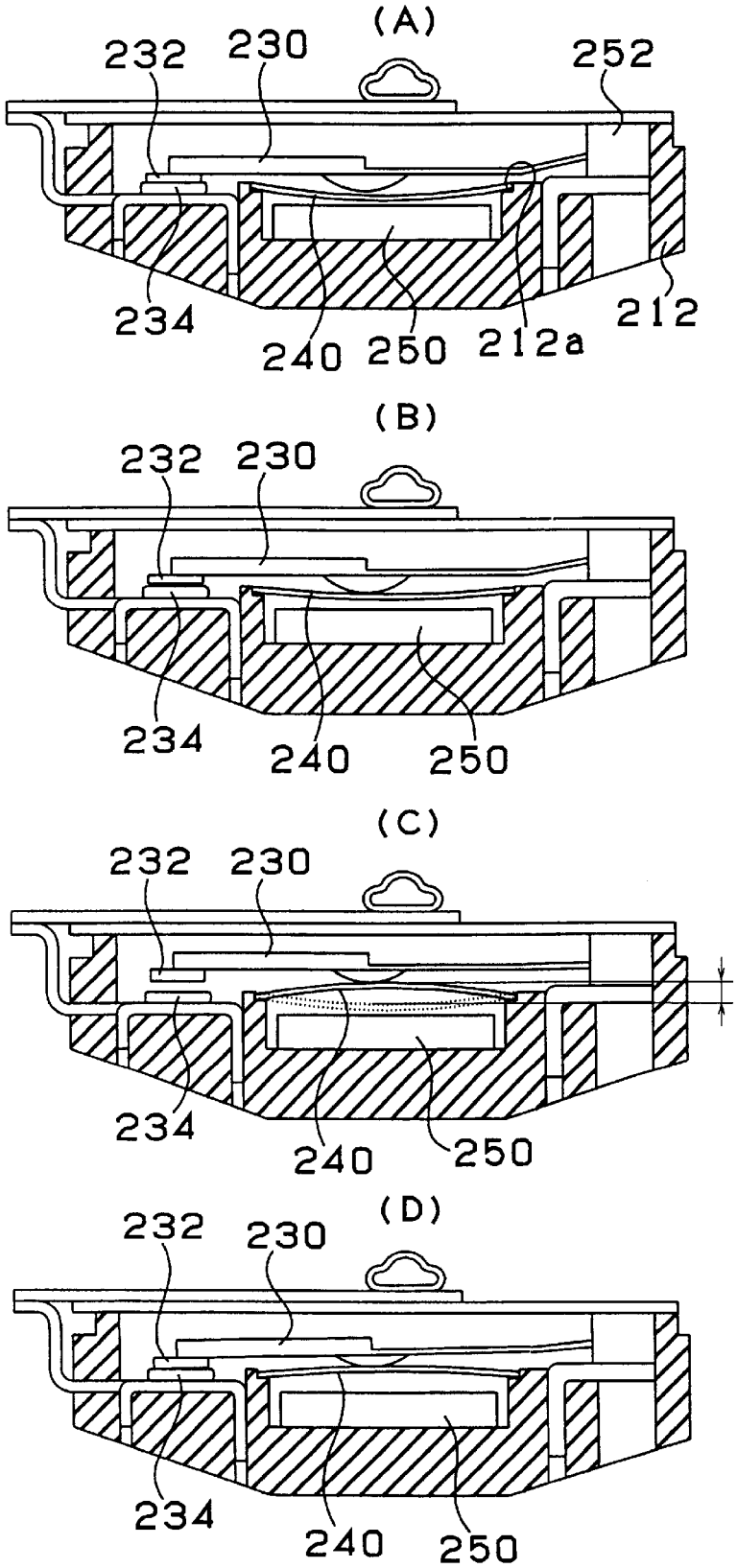
FIGS. 10A, 10B, 10C and 10D are cross-sectional views of a thermal protector according to the prior art.

The bimetal 40 has the holding portion 40*b* secured to the pin 52 and the snap portion 40*a* supported by the support 12*a*. Due to this, the bimetal 40 can obtain desired characteristics only by assembling components thereof without making any adjustments. The holding portion 40*b* is, in particular, made smaller than the snap portion 40*a*. Even if the holding portion 40*b* is secured to the pin, the snap characteristics of the bimetal 40 are the same as a simple conventional bimetal (which is not secured) as shown in FIG. 10, thereby facilitating provision of the bimetal 40 with necessary characteristics.

Meanwhile, the movable contact plate 30 is made of an elastic metal plate and has a free end provided with the contact 32 and has the convex portion 30*a* which generally contacts with the free end 40*a*" of the bimetal 40 at a center thereof.

As shown in FIG. 2H, the movable contact 32 of the movable contact plate 30 secured or welded to the fixed pin 52, together with the bimetal 40, to the connecting plate 44 comes in contact with the fixed contact 34. The fixed contact plate 36 which a fixed contact 34 is mounted, has one end inserted into a thorough hole 12*d* formed at a base 12 side as shown in FIG. 3L; and then fixedly crimped by a through hole 12*d*. The other end extending outside through a through hole or notch (not shown) formed in the cover 14 as shown in FIG. 3K. Outside the cover 14, the fixed contact plate 34 is connected to the pin terminal 24.

As shown in FIG. 21, a convex portion 14*a* is formed at the cover 14 of the thermal protector 10 to allow the movable contact plate 30 to rock upward. An engagement portion 16 is formed at the cover 14 to couple the protector 10 with the actuating relay 80 as shown in FIGS. 1C and 1E. A vertical wall 16*a* extending upward in FIG. 1E, a pair of engagement pieces 16*b* formed perpendicular to the vertical wall 16*a* and a holding piece 16*c* for holding the pin terminal 24 are provided at the engagement portion 16.

Figure 5:
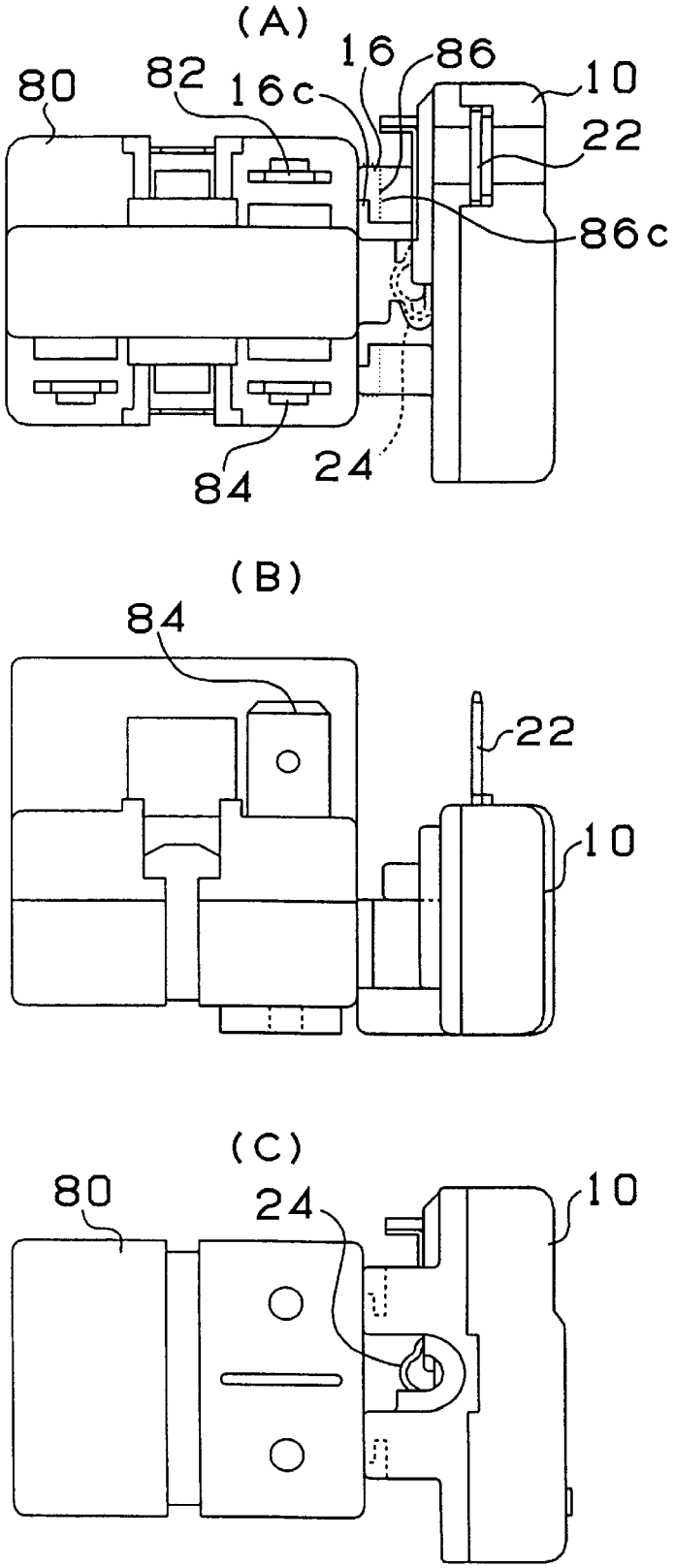
FIG. 5A is a plan view showing a state in which the thermal protector is mounted to the actuating relay.
FIG. 5B is a side view of FIG. 5A.
FIG. 5C is a bottom view of FIG. 5A.

The coupling of the thermal protector 10 to the actuating relay 80 will be described with reference to FIG. 5. FIG. 5A is specifically a plan view showing that the thermal protector 10 is attached to the actuating relay 80, FIG. 5B is a side view thereof; and FIG. 5C is a bottom view thereof.

The actuating relay 80 has the PTC built therein as stated above with reference to FIG. 4, and includes a pin terminal 81 connected to the third terminal 3 of the motor M, a tab terminal 82 connected to the operating capacitor C1 integral with the pin terminal 81, a pin terminal 83 connected to the second terminal T2 of the motor M, a tab terminal 84 connecting to a receptacle to which the operating capacitor integral with the pin terminal 83, an actuating capacitor and a power supply are connected, a tab terminal 85 connected to the operating capacitor C2 and an engagement portion 86 for coupling the actuating relay 80 to the thermal protector 10. An engagement piece 86*b* is provided at the engagement portion 86. If the engagement piece 86*b* of the actuating relay 80 is engaged with the engagement piece 16*b* of the thermal protector 10, the thermal protector 10 is coupled to the actuating relay 80. The actuating relay 80 and the thermal protector 10 which have been coupled to each other as shown in FIG. 5B are attached to the compressor 90 as stated above with reference to FIG. 6.

In the thermal protector 10 in the first embodiment, the bimetal 40 is secured to the fixed pin 52 at the holding portion 40*b* or welded to the connecting plate 44 and the snap portion 40*a* is supported by the support portion 12*a*. The free end 40*a*" of the snap portion 40*a* comes in contact with the movable contact plate 30 to thereby rock the movable contact plate 30. The displacement of the snap portion 40*a* is restricted at a boundary end portion 40*a'* (see FIG. 3M) by the holding portion 40*b*. Due to this, when the thermal protector carries out a snap action (or is reversed), the snap portion 40*a* is rocked like a lever about the support portion 12*a* supporting the snap portion 40*a*. The free end 40*a*" of the snap portion 40*a* is greatly displaced, that is, the stroke S becomes longer. Thus, the travelling distance by which the movable contact 32 travels when the movable contact plate 30 is rocked, can be increased. This can prevent a delay in snap action seen in the conventional thermal protector described with reference to FIG. 10.

Furthermore, in the thermal protector 10 in the first embodiment, the snap portion 40*a* of the bimetal 40 is formed to be generally rectangular as shown in FIG. 3M. The bimetal 40 can develop a strong force during snap action, compared to the flat plate bimetal type. As a result, even if the fixed contact 32 is welded to the movable contact 34, they can be separated from each other.

Figure 7:
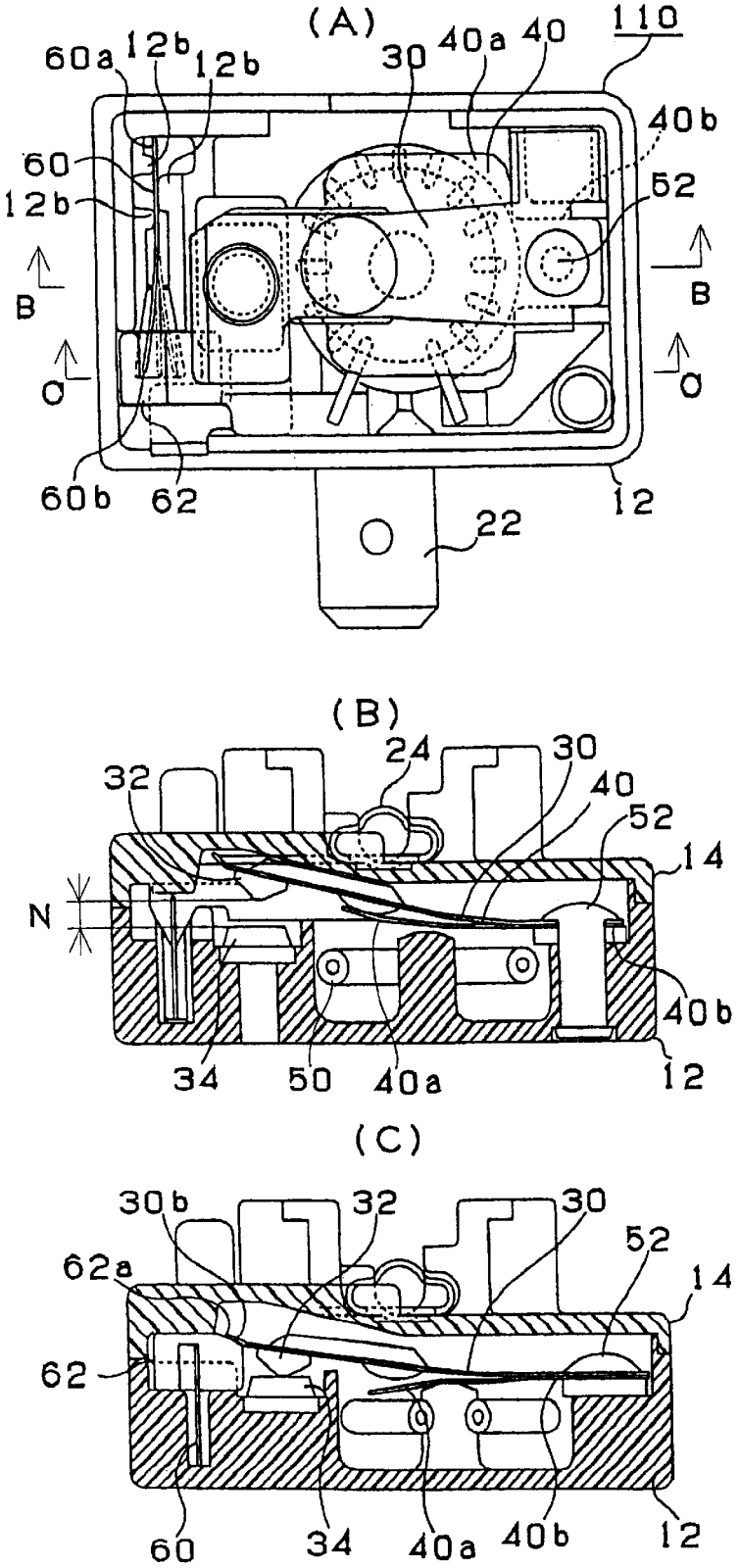
FIG. 7A is a plan view of a thermal protector, showing a state in which a cover is taken off from the protector, in the second embodiment according to the present invention.
FIG. 7B is a cross-sectional view of the thermal protector, taken along line B—B of FIG. 7A.
FIG. 7C is a cross-sectional view thereof, taken along line C—C of FIG. 7A.

A thermal protector 110 in the second embodiment according to the present invention will now be described with reference to FIG. 7.

FIG. 7A is a plan view showing a state in which a cover 14 is taken off from the thermal protector 110, FIG. 7B is a cross-sectional view of FIG. 7A taken along line B—B, and FIG. 7C is a cross-sectional view of FIG. 7A taken along line C—C. The thermal protector 110 in the second embodiment has almost the same structure as that of the thermal protector 10 in the first embodiment described above with reference to FIGS. 1 to 3. In the thermal protector 110 in this embodiment however, a sub-bimetal 60 is provided to separate a fixed point 34 from a movable point 32, as shown in FIG. 7B, when they are welded to each other.

As shown in FIG. 7A, the sub-bimetal 60 has one end 60*a* secured to a fixed portion 12*b* consisting of three convex portions formed at a base 12 and a free end 60*b* provided with a wedge type member 62. The wedge type member 62 has an inclined surface 62*a* formed on the upper surface of the end portion at the movable contact plate 30 side as shown in FIG. 7C. The tip end portion 30*b* of the movable contact plate 30 is slightly bent to abut on the inclined surface 62*a* while the movable contact 32 is contacting with the fixed contact 34.

Now, if the bimetal cannot reversed, the contacts cannot be opened or the fixed contact 34 is welded to the movable contact 32 due to the deterioration of the bimetal, power supply to the motor cannot be stopped. In an abnormal state in which the motor M is constrained or overloaded, excessive current continues to flow through the heater 50 and the temperature of the entire thermal protector 110 becomes high. If so, the sub-bimetal 60 carries out a snap action (or is reversed) to thereby press the wedge type member 62 against the fixed contact 34 and movable contact 32 side (right side in FIG. 7C). By doing so, the inclined surface 62*a* of the wedge type member 62 pushes the tip end portion 30*b* of the movable contact plate 30 up and the fixed contact 34 and movable contact 32 which are welded to each other are separated, thereby terminating current flow through the motor M. The sub-bimetal 60 is constructed such that it is not reversed nor returned to the original state (without a snap action) even if power supply to the motor is terminated and the thermal protector 110 is cooled. Thus, if the sub-bimetal 60 is actuated, the power is kept turned off.

Even if the fixed contact 34 is welded to the movable contact 32 due to the deterioration of the main bimetal 30, current flow can be terminated in an abnormal state in which the motor generates heat abnormally. Thus, the safety of the thermal protector 110 in the second embodiment is ensured.

Figure 8:
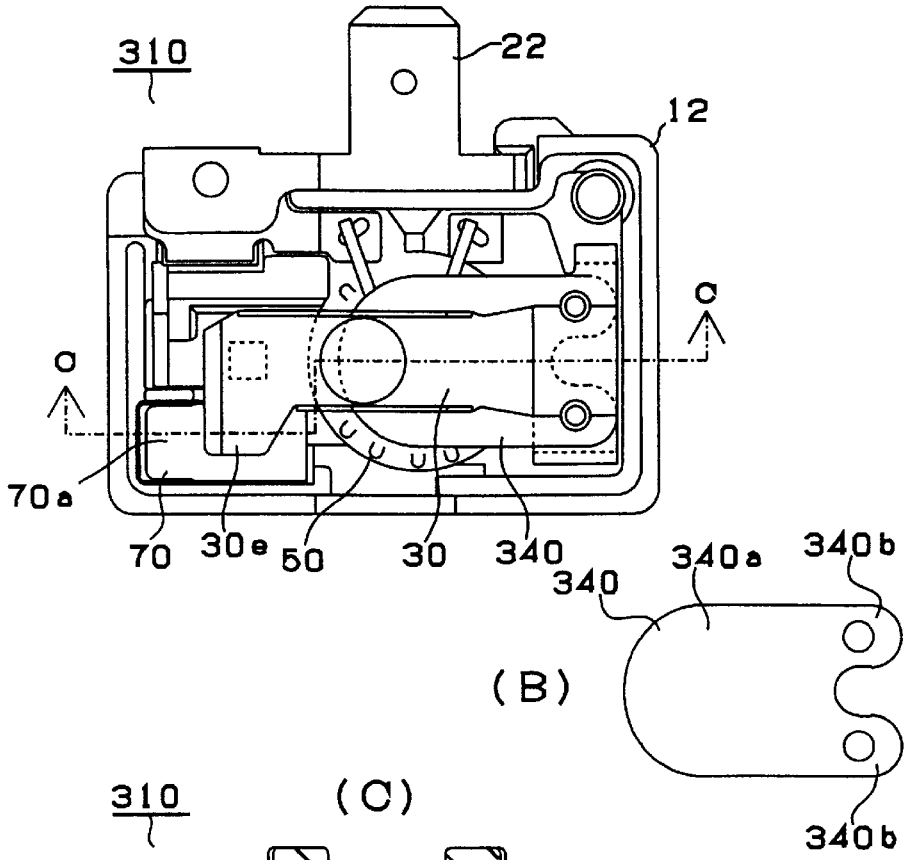
FIG. 8A is a plan view of a thermal protector, showing a state in which a cover is taken off from the protector, in the third embodiment according to the present invention.
FIG. 8B is a plan view of a bimetal used in the thermal protector.
FIGS. 8C and 8D are cross-sectional views of the thermal protector, taken along line C—C of FIG. 8A.
Figure 8:
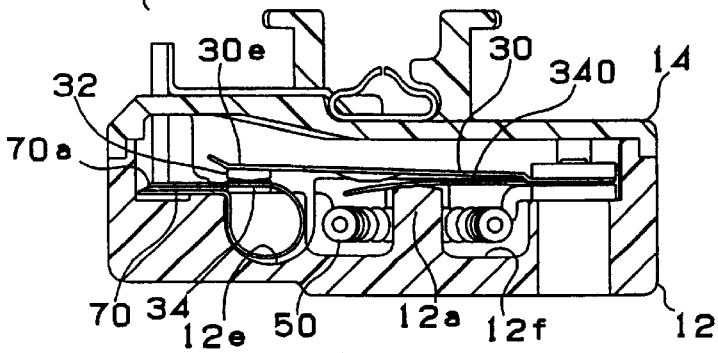
Figure 8:
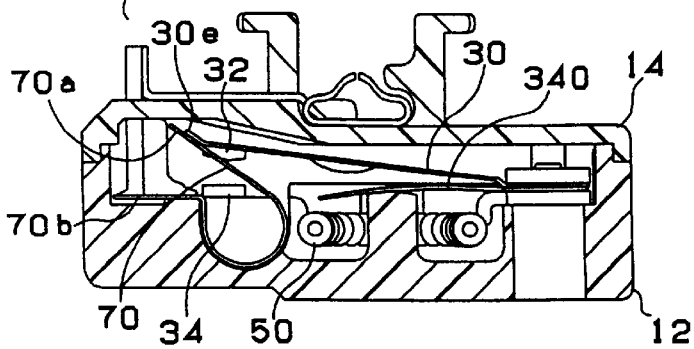
Figure 9:
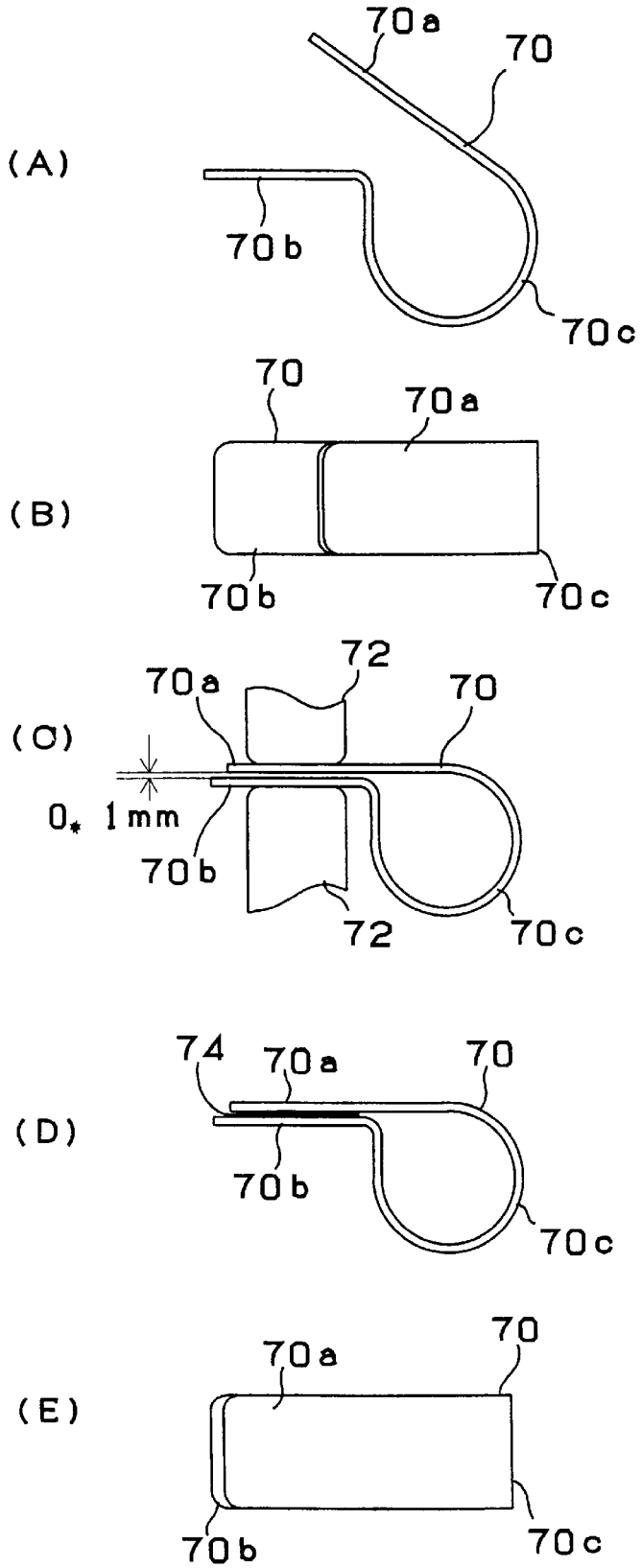
FIG. 9A is a side view of the thermal protector in the third embodiment, showing a state in which a thin plate spring of the protector is opened.
FIG. 9B is a plan view of the thin plate spring of FIG. 9A.
FIG. 9C is a side view of the thin plate spring, showing a step of fixing the end portions of the spring to each other.
FIG. 9D is a side view of the thin plate spring, showing a state in which the end portions have been fixed.
FIG. 9E is a plan view of the thin plate spring of FIG. 9D.

A thermal protector 310 in the third embodiment according to the present invention will be described with reference to FIGS. 8 and 9.

FIG. 8A is a plan view showing a state in which a cover 14 is taken off from the thermal protector 310, FIG. 8B is a plan view of a bimetal 340 used in the thermal protector 310, and FIGS. 8C and 8D are cross-sectional views of the thermal protector 310 taken along line C—C of FIG. 8A. In the thermal protector 310 in the third embodiment, instead of the sub-bimetal in the second embodiment a thin plate spring 70 is provided to separate a fixed contact 34 from a movable contact 32 if they are welded to each other.

Before going into the description of the third embodiment, the structure of the thin plate spring 70 which serves to separate the fixed contact 34 from the movable contact 32 will be described with reference to FIG. 9. FIG. 9A is a side view of the thin plate spring 70 of the thermal protector 310 in the third embodiment, showing that the thin plate spring 70 is opened. FIG. 9B is a plan view of the thin plate spring 70 shown in FIG. 9A. FIG. 9C is a side view thereof, showing a step of fixing the end portions 70*a* and 70*b* of the thin plate spring 70 to each other. FIG. 9D is a side view thereof, showing that the end portions 70*a* and 70*b* have been fixed to each other. FIG. 9E is a plan view of the thin plate spring 70 shown in FIG. 9D.

As shown in FIG. 9A, the thin plate spring 70, made of beryllium copper, consists of a semi-circular spring portion 70*c* and end portions 70*a* and 70*b* extending from the spring portion 70*c*. The end portion 70*b* is bent almost at right angle from the spring portion 70*c*. FIG. 9C shows the step of soldering the end portions 70*a* and 70*b*. In the soldering step, while the distance between the end portions 70*a* and 70*b* being kept at 0.1 mm by jigs 72, 72, a solder is filled in the distance. As shown in FIG. 9D, the both end portions 70*a* and 70*b* are fixed by the solder 74. Although the thin plate spring made of copper alloy is used in this embodiment, a spring member of stainless steel or the like may be used.

The reason for soldering the end portions 70*a* and 70*b* to each other with a distance of 0.1 mm kept therebetween is to ensure appropriate operation even if an intermetallic compound layer is formed out of copper contained in beryllium copper and tin contained in the solder. In other words, if the solder is not thick enough and the intermetallic compound layer is formed, the end portions 70*a* and 70*b* are fixedly attached to each other by the resultant intermetallic compound layer. As a result, the end portions 70*a* and 70*b* cannot be separated even at high temperature. By contrast, when the solder has a thickness of 0.1 mm or more, even if compound layers are formed on the surfaces of the end portions 70*a* and 70*b* respectively, a solder of a sufficient thickness remains between the compound layers. This can prevent the both ends of the thin plate spring from fixedly adhering to each other and thereby prevents a malfunction occurrence. The distance between the both end portions 70*a* and 70*b* is preferably 1 mm or less. The reason for this is that if the distance exceeds 1 mm, the solder may be cracked which causes the end portions to open and other malfunctions. In this embodiment, the solder (a low melting point metal) desirably has a melting point of 170° C. to 240° C.

The structure of the thermal protector in the third embodiment will be described with reference to FIG. 8. As shown in FIG. 8C, the thin plate spring 70 is housed in a depressed portion 12*e* formed at the base 12. The depressed portion 12*e* communicates with a depressed portion 12*f* housing the heater 50 surrounding the support portion 12*a* to allow heat from the heater 50 to be easily transferred to the thin plate spring 70. As shown in FIG. 8A, a horizontal extension 30*e* is formed at the tip end portion of the movable contact plate 30 and positioned above the end portion 70*a* of the thin plate spring 70. In the third embodiment, the bimetal 340 consists of the snap portion 340*a* and a pair of holding portions 340*b* as shown in FIG. 8B. The tip end of the snap portion 340*a* is formed semi-circular.

If the bimetal cannot be reversed, the contacts cannot be opened or the fixed contact 34 and the movable contact 32 are welded to each other due to the deterioration of the bimetal. Power supply to the motor cannot be terminated. In an abnormal state in which the motor M is constrained or overloaded, overcurrent continues to flow through the heater 50 making the temperature of the overall thermal protector 310 reach a high level. If so, the solder 74 of the thin plate spring 70 is molten and the end portion 70*a* flexes upward as shown in FIG. 8D. As a result, the end portion 70*a* pushes the extension (tip end) 30*e* of the movable contact plate 30 up and the fixed contact 34 and movable contact 32 which have been welded are separated from each other, thereby terminating current flow through the motor M. When the end portions 70*a* and 70*b* of the thin plate spring 70 are separated, the power of the thermal protector 310 is kept turned off.

In the third embodiment, even if the fixed contact 34 is welded to the movable contact 32 due to the deterioration of the bimetal 330, current flow can be terminated in an abnormal state in which the motor generates heat abnormally. Thus, the safety of the thermal protector 310 in this embodiment can satisfactorily be ensured.

As stated so far, the present invention (according to), the displacement of the snap portion is restricted at the holding portion, at a boundary end portion in the thermal protector. Owing to this, during snap action, the snap portion rocks in a lever manner about the support portion, while the free end of the snap portion is greatly displaced. This makes it possible to make the travelling distance of the movable contact longer while the movable contact plate is rocked and to thereby prevent a delay in snap action.

What is claimed is:

1. A thermal protector, comprising:

a fixed contact;

a movable contact plate supporting a movable contact that is in contacting engagement with the fixed contact;

a bimetal capable of rocking the movable contact plate to thereby separate said fixed contact from said movable contact; and a heater connected, in series, to said fixed contact and said movable contact and capable of heating said bimetal, wherein said bimetal comprises a snap portion for carrying out a snap action and a holding portion holding the snap portion;

said bimetal is secured at said holding portion and supported by a support member abutting said snap portion, the snap portion having a free end capable of contacting with said movable contact plate and rocking said movable contact plate to thereby separate said fixed contact from said movable contact.

2. The thermal protector according to claim 1, wherein said support member is formed to be columnar and a heater is coiled around said support member.

3. The thermal protector according to claim 1, wherein the snap portion of said bimetal is formed to be generally rectangular.

4. The thermal protector according to claim 2, wherein the snap portion of said bimetal is formed to be generally rectangular.

5. The thermal protector according to claim 1, further comprising an engagement portion engaged with an actuating relay.

6. The thermal protector according to claim 2, further comprising an engagement portion engaged with an actuating relay.

7. The thermal protector according to claim 3, further comprising an engagement portion engaged with an actuating relay.

8. A thermal protector, comprising:

a fixed contact;

a movable contact plate supporting a movable contact that is in contacting engagement with the fixed contact;

a main bimetal capable of rocking the movable contact plate to thereby separate said fixed contact from said movable contact; and a heater connected, in series, to said fixed contact and said movable contact and capable of heating said main bimetal, wherein said main bimetal comprises a snap portion for carrying out a snap action and a holding portion holding the snap portion;

said main bimetal secured by the holding portion, the snap portion having a free end capable of contacting with said movable contact plate to rock the movable contact plate and to thereby separate said fixed contact from said movable contact, and said thermal protector comprises a sub-bimetal having one end secured and the other end provided with a wedge type member, said sub-bimetal rocked perpendicular to a direction in which said fixed contact and said movable contact come in contact with and separate from each other, said sub-bimetal separating said fixed contact from said movable contact by the wedge type member if said fixed contact and said movable contact are welded.

9. The thermal protector according to claim 8, wherein said main bimetal is supported by a support member abutting on said snap portion.

10. A thermal protector, comprising:

a fixed contact;

a movable contact plate supporting a movable contact that is in contacting engagement with the fixed contact;

a bimetal capable of rocking the movable contact plate to thereby separate said fixed contact from said movable contact; and a heater connected, in series, to said fixed contact and said movable contact and capable of heating said bimetal, wherein said bimetal comprises a snap portion for carrying out a snap action and a holding portion holding the snap portion;

the bimetal is secured at said holding portion, the snap portion having a free end capable of contacting with said movable contact plate to rock the movable contact plate and to thereby separate said fixed contact from said movable contact.

11. A thermal protector comprising a fixed contact;

a movable contact plate supporting a movable contact that is in contacting engagement with the fixed contact;

a bimetal capable of rocking the movable contact plate to thereby separate said fixed contact from said movable contact; and a heater connected, in series, to said fixed contact and said movable contact and capable of heating said bimetal, wherein said bimetal is comprised of a snap portion for carrying out a snap action and a holding portion holding the snap portion;

said bimetal secured by the holding portion, the snap portion having a free end capable of contacting with said movable contact plate to rock the movable contact plate and to thereby separate said fixed contact from said movable contact, said thermal protector comprises a thin plate spring having both ends attached to each other by a low melting point metal at a high temperature if said fixed contact is welded to said movable contact, said both ends separated in a direction in which the fixed contact and the movable contact come in contact with and separate from each other to thereby separate the fixed contact from the movable contact.

12. The thermal protector according to claim 11, wherein said bimetal is supported by a support member abutting on said snap portion.

13. The thermal protector according to claim 11, wherein said thin plate spring is made of a spring material of copper alloy, said low melting point metal is made of a solder, and both ends of said thin plate spring are attached to each other through the solder with a distance of 0.1 to 1.0 mm kept therebetween.

14. The thermal protector according to claim 12, wherein said thin plate spring is made of a spring material of copper alloy, said low melting point metal is made of a solder, and both ends of said thin plate spring are attached to each other through the solder with a distance of 0.1 to 1.0 mm kept therebetween.

* * * * *